US006378722B1

(12) United States Patent
Dhellemmes

(10) Patent No.: US 6,378,722 B1
(45) Date of Patent: Apr. 30, 2002

(54) WATERTIGHT AND THERMALLY INSULATING TANK WITH IMPROVED LONGITUDINAL SOLID ANGLES OF INTERSECTION

(75) Inventor: Jacques Dhellemmes, Versailles (FR)

(73) Assignee: Gaz Transport et Technigaz, Trappes (FR)

( * ) Notice: Subject to any disclaimer, the term of this patent is extended or adjusted under 35 U.S.C. 154(b) by 0 days.

(21) Appl. No.: 09/932,087

(22) Filed: Aug. 20, 2001

(30) Foreign Application Priority Data

Aug. 18, 2000 (FR) ..... 00 10704

(51) Int. Cl.[7] ..... B65D 87/24

(52) U.S. Cl. ..... 220/586; 220/592; 220/592.26; 220/651

(58) Field of Search ..... 220/586, 592.19, 220/560.07, 4.13, 651, 652, 653, 654, 592, 592.26

(56) References Cited

U.S. PATENT DOCUMENTS

| | | | | |
|---|---|---|---|---|
| 2,144,945 A | * | 1/1939 | Sutton | 220/651 |
| 3,112,044 A | * | 11/1963 | Larsen et al. | 220/652 |
| 3,150,794 A | | 9/1964 | Schlumberger et al. | 220/9 |
| 3,150,795 A | | 9/1964 | Schlumberger | 220/9 |
| 4,170,952 A | | 10/1979 | McCown | 114/74 A |
| 4,995,528 A | * | 2/1991 | Sharp | 220/651 |
| 5,201,432 A | * | 4/1993 | Elvin-Jensen | 220/4.13 |
| 5,232,119 A | * | 8/1993 | Kauffman | 220/592 |
| 5,320,247 A | * | 6/1994 | Sharp | 220/654 |
| 5,392,946 A | * | 2/1995 | Holbrook et al. | 220/651 |
| 5,464,116 A | * | 11/1995 | Aoki et al. | 220/4.13 |

FOREIGN PATENT DOCUMENTS

| | | |
|---|---|---|
| EP | 0 619 222 A2 | 10/1994 |
| FR | 2629897 | 10/1989 |
| JP | 53107714 | 9/1978 |
| JP | 55072997 | 6/1980 |

* cited by examiner

*Primary Examiner*—Joseph M. Moy
(74) *Attorney, Agent, or Firm*—Connolly Bove Lodge & Hutz

(57) ABSTRACT

Watertight and thermally insulating tank intended for the transportation of liquefied gases by sea, said tank being built into a bearing structure (1) comprising longitudinally adjacent faces (2) forming a dihedron (4); said tank comprising two successive watertightness barriers, one of them a primary watertightness barrier in contact with the product contained in the tank and the other a secondary watertightness barrier (14,55,30,40) arranged between said primary watertightness barrier and the bearing structure, a primary thermally insulating barrier (12,13,24,27,28,29,37,38,51,54, 71) being arranged between these two watertightness barriers and a secondary thermally insulating barrier (15,16,57, 58,31,32,41) being arranged between said secondary watertightness barrier and the bearing structure; said primary watertightness barrier comprising substantially flat running metal strakes (62) and, on each side of the longitudinal solid angle of intersection (A) of at least one of said dihedra, a longitudinal row of corner strakes (65) which are corrugated so that they can deform transversely.

20 Claims, 3 Drawing Sheets

WATERTIGHT AND THERMALLY INSULATING TANK WITH IMPROVED LONGITUDINAL SOLID ANGLES OF INTERSECTION

The present invention relates to a watertight and thermally insulating tank, particularly for storing liquefied gases, such as liquefied natural gases with a high methane content, at a temperature of about −160° C., said tank being built into a bearing structure of a ship, particularly the hull of a ship intended for transporting liquefied gases by sea.

French Patent Application No. 99/07254 discloses such a watertight and insulating tank built into a bearing structure, particularly of a ship, in the form of a polyhedron, particularly an irregular octahedron, the tank corners of which generally make an angle of 90° or 135°; said tank comprising two successive watertightness barriers, one of them a primary barrier in contact with the product contained in the tank and the other a secondary barrier arranged between the primary barrier and the bearing structure, these two watertightness barriers alternating with two thermally insulating barriers. According to that document, the primary watertightness barrier consists of thin metal sheets, particularly substantially flat strakes made of Invar sheet, mechanically held on the primary insulating barrier via their turned-up longitudinal edges.

The secondary barriers and the primary insulating barrier essentially consist of a collection of prefabricated panels fixed mechanically to the bearing structure but not bonded to it, each panel comprising, in succession, a first rigid plate forming the bottom of the panel, a first layer of thermal insulation carried by said bottom plate and with it constituting a secondary insulating barrier element, a second layer of thermal insulation which partially covers the aforementioned first layer and a second rigid plate forming the cover of the panel and covering the second layer of thermal insulation which with said second plate constitutes a primary insulating barrier element.

Still according to that document, the regions where the primary insulating barrier elements of two adjacent panels meet are filled with insulating tiles each consisting of a layer of thermal insulation covered by a rigid plate, the rigid plates of the insulating tiles and the second rigid plates of the panels constituting a substantially continuous wall capable of supporting the primary watertightness barrier, the regions at the joints between the secondary insulating barrier elements being filled with connectors made of insulating material.

Also known from French patent No. 2 683 786 is a secondary insulating barrier consisting of a number of caissons each of which comprises a parallelepipedal box made of plywood equipped internally with longitudinal and transverse partitions and filled with an insulant in particulate form known by the name of perlite. However, these insulating barriers have a complex structure and are expensive to manufacture.

In order to produce said layers of thermal insulation, it is known practise to use cellular foam, particularly polyurethane foam having, for example, a density of about 105 $kg/M^3$, or cellular foam reinforced, for example, with glass fibers, and having, for example, a density of about 120 $kg/m^3$. The use of said prefabricated panels considerably reduces the time and cost involved in producing the tank.

It is known that when the ship moves about in the swell, the deformation of its hull generates, at the primary and secondary watertightness barriers, very high tensile stresses which add to the tensile stresses generated in these watertightness barriers by the cooling of the tank. As is known, expansion gussets formed by the turned-up longitudinal edges of the Invar strakes allow the primary watertightness barrier to be given limited stretch in its transverse direction, of the order of 0.3 to 0.6 mm per meter so as to elastically absorb the tensile stresses generated by the cooling of the tank and so as to compensate for the corresponding contraction of the strakes.

However, when layers of thermal insulation made of cellular foam are used, these have a tendency, given that they are compressible, to compress and contract substantially perpendicularly toward the walls of the bearing structure, under the action of the static pressure of the contents of the tank, and of the dynamic pressure produced on the walls of the tank by the movements of the liquid during transport, which movements are due to the rolling and pitching of the ship. Such compression and contraction also contributes to generating tension in the primary watertightness barrier, particularly in the transverse direction of the strakes, and particularly near the longitudinal solid angles of intersection of the tank. In a known way, the primary watertightness barrier can be produced using steel sheet elements which have transverse and longitudinal ribs butt-welded together to form a goffered surface. The ribs of such a surface can open up to allow the primary watertightness barrier to stretch. However, such elements exhibit significant movements of thermal expansion and contraction. On the other hand, when substantially flat strakes made of Invar sheet with turned-up longitudinal edges are used in association with a compressible layer of thermal insulation, the thermal contraction movements are of more limited amplitude but there is a risk that the primary watertightness barrier will become damaged under the compression and contraction of the layer of insulation, because they generate transverse tensile forces on the watertightness barrier, the expansion gussets at the turned-up edges of which may prove insufficient to allow a corresponding elongation.

The purpose of the invention is to provide such a tank, the walls of which have prefabricated panels such as the aforementioned ones, but which does not have the aforementioned drawbacks.

For that, the invention provides a watertight and thermally insulating tank built into a bearing structure, particularly of a ship, said bearing structure having a number of substantially flat faces adjacent via their longitudinal edges and having a polygonal cross section, each pair of longitudinally adjacent faces forming a dihedron, said tank comprising two successive watertightness barriers, one of them a primary watertightness barrier in contact with the product contained in the tank, and the other a secondary watertightness barrier arranged between said primary watertightness barrier and the bearing structure, a primary thermally insulating barrier being arranged between these two watertightness barriers and a secondary thermally insulating barrier being arranged between said secondary watertightness barrier and the bearing structure, the secondary insulating and watertightness barriers and the primary insulating barrier being essentially formed of a collection of wall elements juxtaposed on the bearing structure over substantially its entire interior surface, said wall elements being partially deformable in the direction of their thickness, said wall elements being capable of supporting and of retaining the primary watertightness barrier, said primary watertightness barrier having substantially flat running metal strakes made of thin sheet metal with a low coefficient of expansion, the longitudinal edges of which are turned up toward the inside of the tank, each running strake being assembled watertightly with at least one longitudinally adjacent running strake, the adjacent turned-up edges of said running strakes being welded to the two faces of a weld support which is mechanically held on said wall elements, characterized in that said primary watertightness barrier comprises, on each side of the longitudinal solid angle of intersection of at least one of said dihedra, a longitudinal row of corrugated corner strakes, each corner strake having a first longitudinal edge, opposite said solid angle of intersection of the dihedron, which is turned up toward the inside of the tank and welded to one face of a weld support held mechanically on said wall elements, the longitudinal edge of a running strake longitudinally adjacent to said corner strake being welded to the other face of said weld support, each corner strake comprising at least one corrugation between its two longitudinal edges so as to be capable of deforming transversely to elastically follow any deformation there might be of said wall elements supporting said primary watertightness barrier, it being possible for said deformation to be brought about by the static or dynamic pressure of the product contained in said tank and/or the thermal contraction.

As a preference, each corner strake has several, preferably three, corrugations of substantially the same height or of the same height.

Advantageously, the primary watertightness barrier comprises, at said solid angle of intersection of the dihedron, a metal angle bracket, the angle of which is substantially equal to the angle of said dihedron, each corner strake having its second longitudinal edge welded to said metal angle bracket.

As a preference, said wall elements comprise, on their opposite face to said bearing structure, support plates forming a substantially continuous wall; each leg of said angle bracket being fixed to at least one of said support plates by at least one fixing screw engaged through an oblong hole in said leg and fixed into said support plate, said oblong hole being substantially perpendicular to said solid angle of intersection of the dihedron so as to offer said leg limited freedom of movement in this direction with respect to said support plate; each oblong hole being covered by a corner strake, one longitudinal edge of which is fixed to said leg between the solid angle of intersection of said angle bracket and said oblong hole.

According to another feature of the invention, said wall elements comprise, along said solid angle of intersection of the dihedron, prefabricated corner structures, each corner structure comprising two substructures designed and arranged substantially symmetrically with respect to the plane that bisects said dihedron, each of said substructures having, in succession, through its thickness: a first rigid plate forming the bottom of the substructure, fixed mechanically and/or bonded to said bearing structure, a first layer of thermal insulation carried by said bottom plate, a second rigid plate covering substantially the entirety of said first layer to provide, with it and said bottom plate, a secondary insulating barrier element, a secondary watertightness barrier element bonded onto said second plate, a second layer of thermal insulation which partially covers said second plate, forming thereon a border not covered by said second layer, and a third rigid plate forming said support plate of the substructure and covering the second layer of thermal insulation to provide, with it, a primary insulating barrier element; the respective bottom plates of said substructures being respectively substantially parallel to the two faces of said dihedron.

As a preference, the two legs of said angle bracket are fixed respectively to the support plates of said two substructures.

Advantageously, a rigid thrust plate is inserted between the secondary insulating barrier elements of said two substructures substantially in said plane that bisects the dihedron, said secondary insulating barrier elements of the two substructures each having a longitudinal face substantially parallel to said bisecting plane and bearing against said thrust plate.

As a preference, the secondary insulating barrier elements of the two substructures of each corner structure have a facet cut substantially at right angles to said bisecting plane so as to define an empty space between said corner structure and the solid angle of intersection of the dihedron of the bearing structure, a sheet of tension-resistant insulating material covering said cut facet in order to hold said two substructures together.

Advantageously, each corner structure comprises a continuous, gas tight and liquid tight flexible web, preferably comprising a continuous deformable thin sheet of aluminum interposed between two sheets of glass fabric, two border parts of which are respectively fixed watertightly to the secondary watertightness barrier elements of the two substructures, a central part of said web, which passes through said bisecting plane not being fixed to said substructures, so as to allow it to adopt a variable curvature as corner structures deform in said way.

As a preference, a corner gasket made of flexible insulating material is inserted between the primary insulating barrier elements of said two substructures and on said web, said corner gasket not being fixed to said web.

Advantageously, the bearing structure comprises metal flats welded to its internal surface parallel to said solid angle of intersection of the dihedron and on each side thereof, the bottom plate of each substructure of a corner structure being positioned between said solid angle of intersection of the dihedron and one of said flats; a corner structure being fixed to the bearing structure using studs welded substantially perpendicularly to the internal surface of the bearing structure, said studs each having their free end threaded, the studs being arranged in such a way that the studs lie between said solid angle of intersection of the dihedron and said flats, in line with said border not covered with the secondary insulating barrier elements of each substructure, a well being formed in line with each stud through the second plate and the first layer of thermal insulation of a substructure, the bottom of the well being formed by the bottom plate of said substructure and having an elongate orifice to allow a stud to pass, a washer being placed over the stud to rest against the bottom plate, held on by a nut screwed onto said stud, said elongate orifice being oriented substantially at right angles to said solid angle of intersection of the dihedron, said stud being engaged near the end of said elongate orifice away from said solid angle of intersection of the dihedron so as to allow said bottom plate a limited movement with respect to said bearing structure toward said flat, a deformable wad, preferably of curable resin, being inserted between said flat and said bottom plate.

According to yet another feature of the invention, said wall elements comprise prefabricated panels, each panel comprising, in succession, through its thickness: a first rigid sheet forming the bottom of the panel, fixed mechanically and/or bonded to said bearing structure, a first layer of thermal insulation carried by said bottom plate to provide, with it, a secondary insulating barrier element, a second layer of thermal insulation which partially covers said first layer, forming thereon a border not covered by said second layer, and a second rigid sheet forming said support plate of the panel and covering the secondary layer of thermal insulation to provide, with it, a primary insulating barrier element.

As a preference, said wall elements also comprise insulating tiles, each comprising a layer of thermal insulation covered by a rigid plate forming said support plate for the insulating tile, at least one of said insulating tiles being bonded in each region where the primary insulating barrier element of a substructure of the corner structure meets the primary insulating barrier element of a panel adjacent to said corner structure, so as to fill the region of this joint.

Advantageously, the angle of said dihedron is greater than 90°, and preferably substantially equal to 135°.

The invention will be better understood and further objects, details, features and advantages thereof will become more clearly apparent from the following description of one particular embodiment of the invention given merely by way of nonlimiting illustration with reference to the appended drawing. In this drawing.

Figure 1:
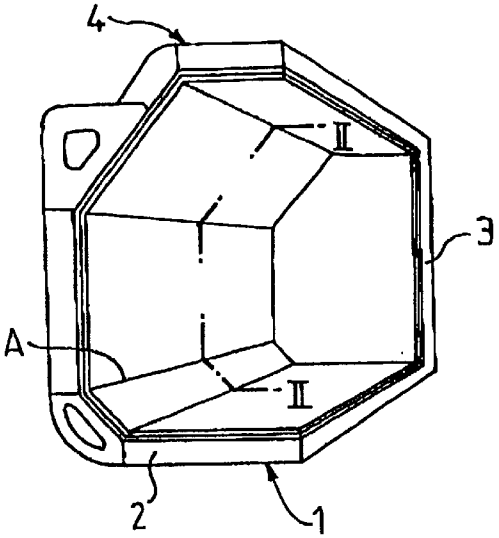
FIG. 1 is a partial view in perspective and in section of the tank according to the invention in the bearing structure.

FIG. 1 shows the wall of the double hull of the ship, in which the tank according to the invention is installed. This double wall forms compartments each defined by a number of substantially flat longitudinal faces 2 welded along their longitudinal edges to form, overall, a section of a cylinder or of a cone and along transverse bulkheads 3 at the longitudinal ends of the compartment. The longitudinal faces 2 and the transverse bulkheads 3 of one compartment constitute the bearing structure 1 of the tank which will be described. The transverse bulkheads 3 are also double. In general, the longitudinal faces 2 are arranged overall in the form of a cone with a polygonal director curve in the bow part (not depicted) of said ship, and in the form of a cylinder with a polygonal director curve, as visible in FIG. 1, in the rest of the ship. Each pair of adjacent longitudinal faces 2 defines a dihedron 4, the solid angle of intersection A of which substantially coincides with a welded seam 5 connecting the pair of faces. As visible in FIG. 1, the angle $\alpha$ of each dihedron 4 is substantially equal to 135°, the cross section of the bearing structure 1 being substantially octagonal.

Figure 2:
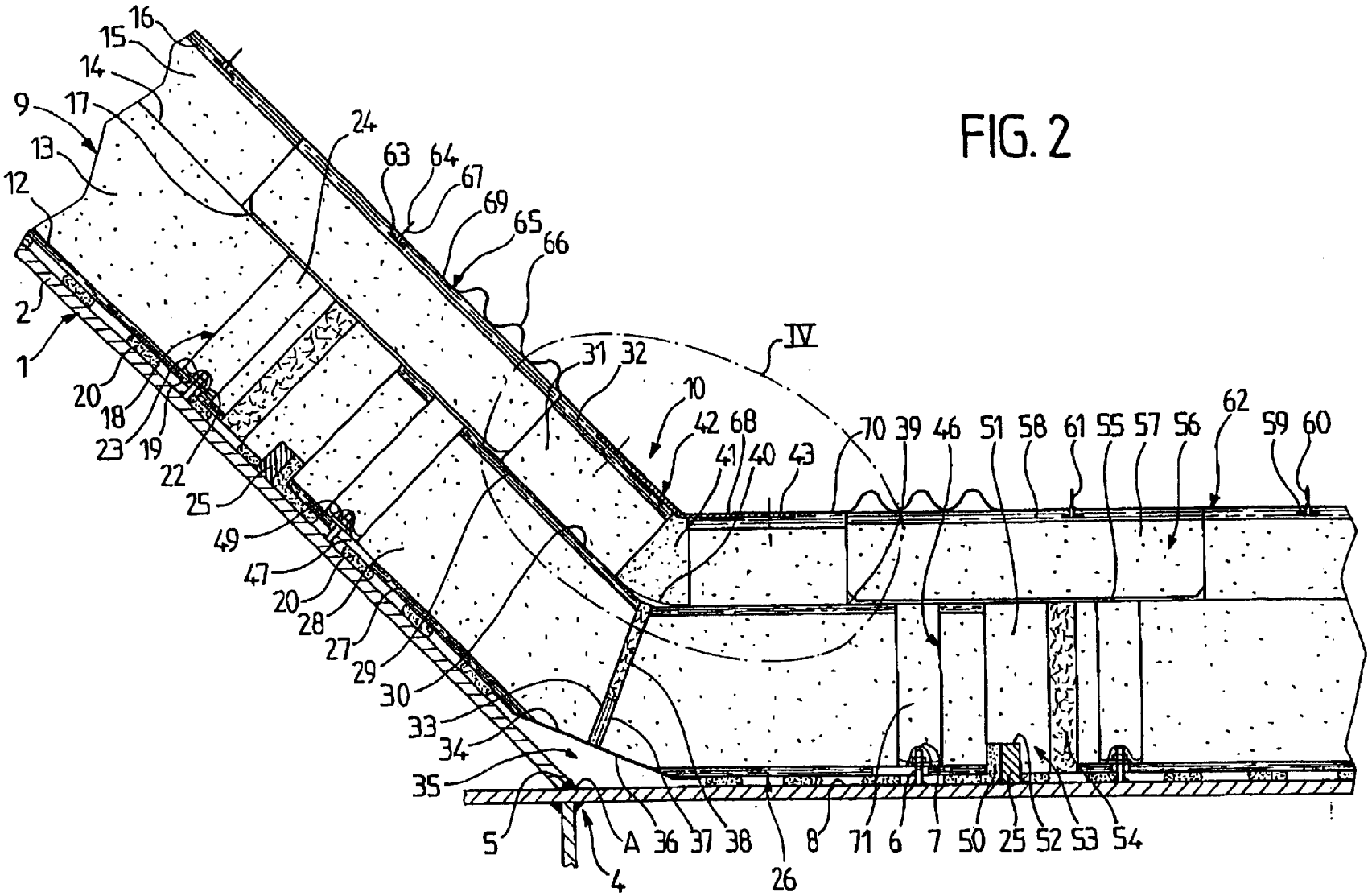
FIG. 2 is a partial view in section on II—II of FIG. 1 of the wall of the tank on each side of a longitudinal dihedron.
Figure 3:
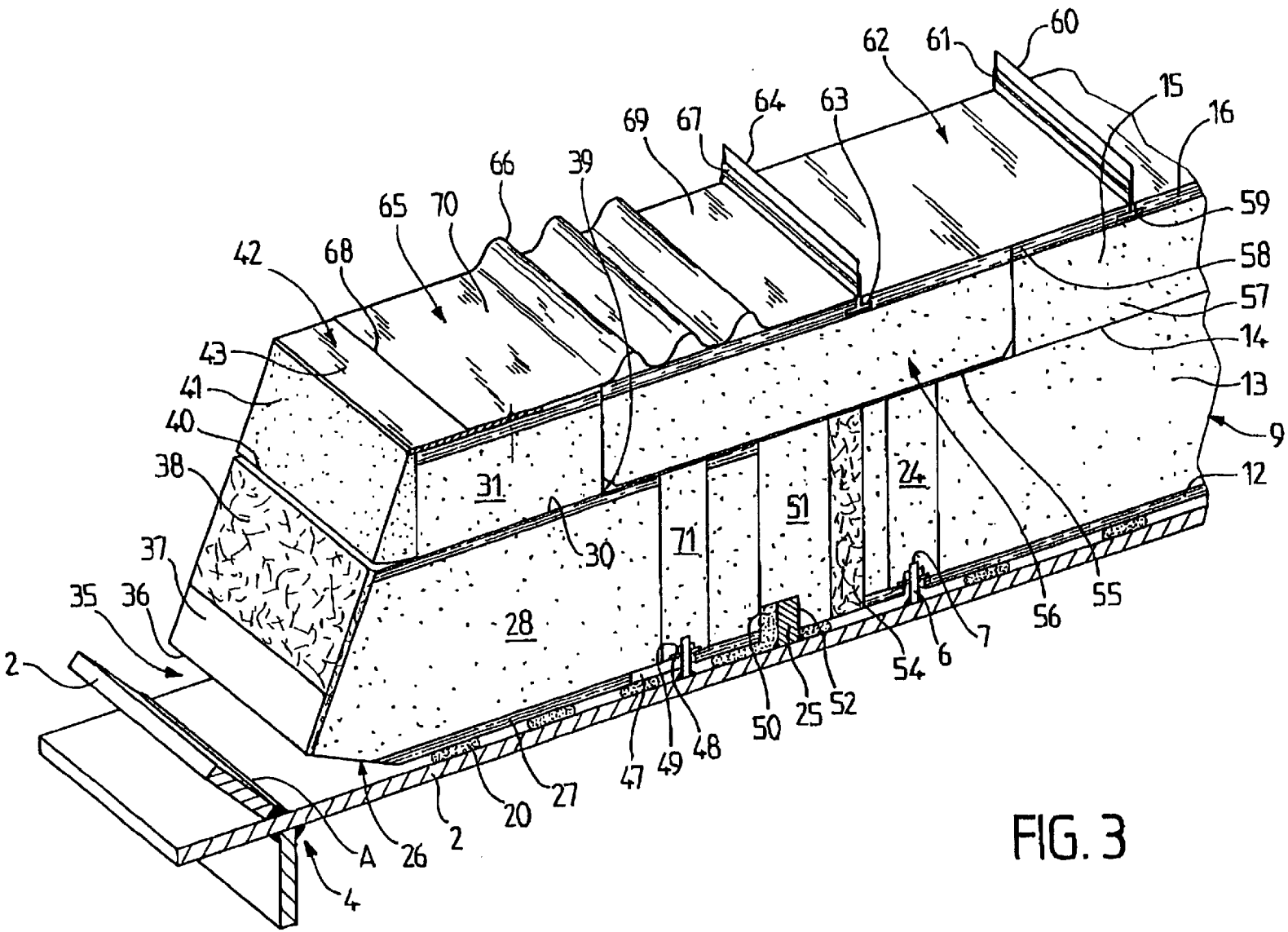
FIG. 3 is a partial view in one quarter perspective and section of the wall of the tank of FIG. 2.

As visible in FIGS. 2 and 3, the longitudinal faces 2 and the transverse bulkheads 3 (not depicted) each bear studs 6 which are welded to them perpendicularly and the free end 7 of which is threaded. On the longitudinal faces 2, the studs 6 are arranged in longitudinal rows.

The two secondary barriers and the primary insulating barrier are produced using prefabricated wall elements juxtaposed and held over substantially the entire internal surface 8 of the bearing structure 1. The wall elements in particular comprise panels 9, partially visible in FIGS. 2 and 3, corner structures 10 and insulating tiles 46 fitted between the corner structures 10 and the juxtaposed panels 9.

A panel 9 has substantially the shape of a right-angled parallelepiped; it comprises a first sheet 12 of plywood 9 mm thick surmounted by a first layer of thermal insulation 13, itself surmounted by a secondary watertightness barrier element consisting of a strip of triplex comprising a sheet of aluminum 14 about 0.1 mm thick bonded to a first fiberglass fabric and itself partially covered by a second fiberglass fabric bonded to it; bonded with a polyurethane adhesive to this second fabric is a second layer of thermal insulation 15 which itself carries a second sheet of plywood 16 12 mm thick. The subassembly 15 to 16 constitutes a primary insulating barrier element and, in plan view, has a rectangular shape, the sides of which are parallel to those of the subassembly 12 to 13; the two subassemblies have, in plan view, the shape of two rectangles having the same center, a peripheral rim 17, of constant width, running right around the subassembly 15 to 16 and consisting of the border of the subassembly 12 to 13. The subassembly 12 to 13 constitutes a secondary insulating barrier element.

The panel 9 which has just been described can be prefabricated to constitute an assembly, the various constituent parts of which are bonded together in the arrangement mentioned above; this assembly therefore forms the secondary barriers and the primary insulating barrier. The layers of thermal insulation 13 and 15 may consist of a cellular plastic material such as a polyurethane foam which has been given good mechanical properties by inserting fiberglass therein to reinforce it. Such a reinforced foam has, for example, a density of about 120 kg/m$^3$.

To fix the panels 9 to the bearing structure there are provided, uniformly distributed along the two longitudinal edges of the panel, wells 18 which are recesses of U-shaped cross section made in the peripheral rim 17 through the sheet 14, the first fabric and the first layer of insulation 13, down to the sheet of plywood 12. The bottom of a well 18 consists of the first rigid sheet 12 of the panel 9; the bottom of the well 18 is perforated to form an orifice 19, the diameter of which is large enough to allow a stud 6 to pass. The studs 6 and the orifices 19 are arranged in such a way that if a panel 9 is brought up to face a longitudinal face 2 or a transverse bulkhead 3 of the bearing structure 1, said panel 9 can be positioned in such a way that a stud 6 engages in each orifice 19. The wells 18 are open onto the transverse walls (not depicted) of the subassembly 12 to 13.

It is known that the wall of the double hull of a ship is offset in some way from the theoretical surface intended for the bearing structure 1, simply as a result of manufacturing inaccuracies. In the known way, these offsets are compensated for by resting the panels 9 against the bearing structure 1 via wads of curable resin 20 which, starting out with an imperfect internal surface 8 of the bearing structure, make it possible to obtain a lining consisting of adjacent panels 9 exhibiting first sheets 12 which, overall, define a surface which exhibits practically no offset from the desired theoretical surface. The panels 9, the wads 20 and the internal surface 8 are bonded together 1.

When the panels 9 are thus offered up against the bearing structure 1 with the interposition of the wads of resin 20, the studs 6 penetrate the orifices 19 and a thrust washer 22 and a tightening nut 23 are fitted onto the threaded end 7 of the studs 6. The washer 22 is pressed by the nut 23 against the first rigid sheet 12 of the panel 9, at the bottom of the well 19. Thus each panel 9 is fixed against the bearing structure 1 by a number of points spread around the periphery of the panel 9, which is favorable from a mechanical point of view. When such fixing has been achieved, the wells 19 are plugged by inserting plugs 24 of thermally insulating material therein, said plugs 24 lying flush with the first layer of thermal insulation 13 of the panel. The orifices 19 have a larger cross section than the studs 6 to form a limited amount of clearance allowing the panels 9 with their own tolerances to be mounted.

In a way which is known, for example from French Patent application No. 99/07254, the panels 9 described above make it possible to cover the internal surface of all the longitudinal faces 2 and bulkheads 3 of the bearing structure 1, except for their corner regions, to form the two insulating barriers and the secondary watertightness barrier. To do that, in a known way, the suitable insulating tiles are used to join the juxtaposed panels 9. The installing of such coverage will therefore not be described below. The means according to the invention of achieving and supplementing such coverage along the longitudinal solid angles of intersection A of the bearing structure 1 will now be described.

Two metal flats 25 are welded on each side of the solid angle of intersection A of each dihedron 4, substantially equal distances from said solid angle of intersection A and parallel thereto, along the respective internal surface 8 of the two longitudinal faces 2 that form said dihedron 4. The coverage of the internal surface 8 of the longitudinal faces 2 of the bearing structure 1 by the panels 9 stops on the outside with respect to the solid angle of intersection A of the longitudinal boundary formed by the metal flats 25. Corner structures 10 are juxtaposed longitudinally along each solid angle of intersection A between the two flats 25 that flank the solid angle of intersection A.

Each corner structure 10 has overall the shape of a V, the angle of which is substantially equal to the angle of the dihedron 4, the corner structure 10 comprising two substructures 26 forming the two legs of the V. The two substructures 26 are designed and arranged symmetrically with respect to the plane that bisects the corner structure 10, and the corner structure 10 is arranged straddling the solid angle of intersection A with its bisecting plane substantially coinciding with the plane P that bisects the dihedron 4.

Each substructure 26 comprises a first sheet 27 of plywood 9 mm thick surmounted by a first layer of thermal insulation 28, then by a second sheet 29 of plywood 9 mm thick, itself surmounted by a secondary watertightness barrier element 30 consisting of a strip of triplex comprising an aluminum sheet about 0.1 mm thick bonded to a first fiberglass fabric and itself partially covered by a second fiberglass fabric bonded onto it; bonded with a polyurethane adhesive onto this secondary watertightness barrier element 30 is a second layer of thermal insulation 31 which itself carries a third sheet of plywood 32 15 mm thick. The subassembly 27 to 29 and the subassembly 31 to 32 respectively constitute a secondary insulating barrier element and a primary insulating barrier element. The two subassemblies each overall have a right-angled parallelepipedal shape and are stacked with their faces parallel to each other. The rectangular faces of the two subassemblies which are substantially parallel to the longitudinal face 2 supporting the first sheet 27 have their centers aligned on a line substantially perpendicular to the longitudinal face 2.

At its transverse end facing toward the solid angle of intersection A, the secondary insulating element has two substantially perpendicular projecting faces, the first 33 of the two faces being parallel to the bisecting plane P and intersecting the second sheet 29 and part of the thickness of the first layer of insulation 28, the second 34 of the two faces being perpendicular to the bisecting plane P and intersecting the remainder of the thickness of the first layer of insulation 28 and the first sheet 27. The faces 34 of the two substructures 26 are aligned to form a facet cut at the base of the V of the corner structure 10. This cut facet leaves a drainage space 35 of substantially triangular cross section between said corner structure 10 and the solid angle of intersection A of the dihedron 4. An insulating and tension-resistant fabric 36, made of glass or composite, consisting for example of a thin sheet of aluminum between two sheets of fiberglass, is bonded to the cut facet formed by the faces 34 with its border protruding under the plates 27 of the two substructures 26, so as to hold these together when the corner structure 10 is put in place on the bearing structure 1.

The faces 33 of the two substructures 26 are parallel and bear in their part adjacent to the faces 34 against the two faces of a thrust plate 37 which is substantially rectangular and made of plywood 9 mm thick and which is bonded to the first layers of insulation 28 and positioned substantially in the bisecting plane P. The thrust plate 37 covers only part at the base of the faces 33. The gap that remains between the two faces 33 above it is filled with a flexible strip of insulation 38, for example made of glass wool.

The subassembly 31 to 32 of the substructure 26 has a cross section in the plane of the longitudinal face 2 which is smaller than that of the subassembly 27 to 30 so that a peripheral rim 39, of constant width, exists on the secondary watertightness barrier element 30 all around the subassembly 31 to 32. To ensure continuity of the secondary watertightness barrier between the two substructures 26, a flexible strip 40 is fitted between the parts of the rim 39 of the two substructures 26 which face toward the solid angle of intersection A. Part of the border of the strip 40 is bonded watertightly to the secondary watertightness barrier element 30 of each substructure 26, while a central part of the strip 40 passing through the bisecting plane P over the insulating strip 38 is not fixed, so that the flexible strip 40 can adopt a variable curvature when the corner structure 10 undergoes deformation. The flexible strip 40 consists of a composite material consisting of three layers: the outer two layers are fiberglass fabrics and the intermediate layer is a thin metal sheet, for example an aluminum sheet about 0.1 mm thick. This metal sheet ensures continuity of the secondary watertightness barrier; its flexibility, on account of its small thickness, allows it to follow the deformations of the substructures 26 which are due to the deformation of the hull in the swell or to the cooling of the tank.

Those parts of the rim 39 and those faces of the primary insulating elements of the two substructures 26 which face toward the bisecting P delimit a space into which a flexible gasket 41, for example made of low-density polyurethane foam, is inserted, this being intended to prevent convective movements which would encourage heat transfer to inside the tank. The flexible gasket 41 may be bonded to the primary insulating elements but not to the flexible strip 40.

A metal angle bracket 42, of an angle substantially equal to the angle $\alpha$ of the dihedron 4, is fixed with one leg 43 on each of the third plates 32 of the corner structure 10 and with its solid angle of intersection substantially in the bisecting plane P parallel to the solid angle of intersection A, so as to provide a primary watertightness barrier element. Each leg 43 laterally covers substantially two-thirds of the third plate 32 which carries it, the corresponding part of the upper face of the third plate 32 having a spot face to accommodate the leg 43 substantially even with the remainder of the third plate 32. The leg 43 is fixed to the third plate 32 by fixing screws 44 aligned parallel to the solid angle of intersection A. Each fixing screw 44 is engaged in an oblong hole 45 of the leg 43 which is oriented substantially at right angles to the solid angle of intersection A and is screwed into the entire thickness of the third plate 32. As the tank is obviously empty when the corner structures 10 are being fitted, the fixing screws 44 are situated substantially at that end of the oblong holes 45 which is closest to the solid angle of intersection of the angle bracket 42 so as to allow, when the tank is filled, a limited movement away from the bisecting plane P of the substructure 26 relative to the angle bracket 42.

The corner structure 10 which has just been described can be prefabricated to constitute a wall element, the various constituent parts of which are assembled by bonding them together in the arrangement mentioned above. The layers of thermal insulation 28 and 31 may be constructed in the same way as those of the panels 9.

To fix the corner structures 10 to the bearing structure 1 there are, as in the case of the panels 9, wells 46 uniformly distributed along the outer longitudinal edges of the substructures 26 and made in the peripheral rim 39 through the secondary watertightness barrier element 30, the second plate 29 and the first layer of insulation 28 down to the first plate 27. The wells 46 are open on the transverse walls (not depicted) of the subassembly 27 to 30. The bottom of a well 46 consists of the first plate 27 of a substructure 26 which is perforated to form an elongate orifice 47 oriented substantially at right angles to the solid angle of intersection A and which is wide enough to allow a stud 6 to pass. Studs 6 are arranged in such a way that when a corner structure 10 is brought up to face a dihedron 4 between the flats 25, said corner structure 10 can be positioned in such a way that a stud 6 engages in the outer end, with respect to the solid angle of intersection A, of each elongate orifice 47.

As with the panels 9, the corner structures 10 are rested against the bearing structure 1 via wads of curable resin 20 which, starting out with an imperfect internal surface 8 of the bearing structure 1, make it possible to obtain good alignment of the first plates 27 with the first sheets 12 of the adjacent panels 9. Deformable blocks 50, also made of curable resin, are inserted between the outer longitudinal edge of the first plate 27 of each substructure 26 and the flat 25 facing it so as to position the corner structure 10, while building in a limited freedom of the substructure 26 to move parallel to the longitudinal face which carries it 2 toward said flat 25, it being possible for the stud 6 to slide in the elongate orifice 47 during such a movement. As a preference, the deformable block 50 is made as a single piece with a wad 20 supporting the first plate 27, so that the block 50 is substantially L-shaped. The corner structures 10, the wads 20 and the internal surface 8 are bonded together.

The corner structures 10 are held on the bearing structure 1 by thrust washers 48, of a diameter greater than the width of the elongate orifices 47, engaged on the threaded end 7 of the studs 6 and pressed by nuts 49 against the first plate 27 of the substructures 26 at the bottom of the wells 46. When such fixing has been achieved, the wells 46 are plugged by inserting plugs 71 of thermally insulting material into them, said plugs 71 lying flush with the secondary watertightness barrier element 30 of each substructure.

In each junction region separating a substructure 26 from an adjacent panel 9, the space between the longitudinal faces of the panel 9 and of the substructure 26 facing each other on each side of a flat 25 against which the substructure 26 is wedged, is filled with an insulating brick 51, for example of fiberglass-reinforced polyurethane foam, which has substantially a right-angled parallelepipedal shape. The insulating brick 51 is in contact with said longitudinal face of the substructure 26, its side 53 resting against the bearing structure 1 having a rectangular longitudinal recess 52 to accommodate the flat 25 and the deformable block 50. The two faces of the recess 52 are pressed against the flat 25, against its upper face and its opposite longitudinal face to the substructure 26. The part of the side 53 adjacent to the recess 52 is pressed against the bearing structure 1 via a wad 20. The opposite face of the insulating brick 51 to its side 53 is substantially aligned, in a plane parallel to the longitudinal face 2 of the bearing structure 1, with the upper face of the second plate 29 of the substructure 26 and with the upper face of the first layer of insulation 13 of the panel 9.

A thermally insulating material 54 consisting, for example, of a sheet of glass wool bent back on itself into the shape of a U, is then forcibly inserted between each foam brick 51 and the adjacent panel 9 and lies substantially flush in the plane [lacuna] their aligned faces.

Nonetheless, while the continuity of the secondary insulating barrier has thus been reconstituted, the same is not true of the continuity of the secondary watertightness barrier formed by the sheet 14 of the panel 9 and the secondary watertightness barrier element 30 of the substructure 26 because these are perforated at each well 18 and 46 respectively. A flexible strip 55, similar in construction to the flexible strip 40 of the corner structure 10, is bonded between the peripheral rim 17 of the panel 9 and the peripheral rim 39 of the substructure 26, its central part covering and being bonded to the insulating brick 51, the thermally insulating material 54, the transverse end of the peripheral rims 17 and 39 and the wells 18 and 46. The flexible strip 55 is bonded via its longitudinal border parts on the one hand to the secondary watertightness barrier element 30 between the well 46 and the primary insulating barrier element of the substructure 26 and, on the other hand, to the secondary watertightness sheet 14 between the well 18 and the primary insulating barrier element of the panel 9, which reconstitutes the continuity of the secondary watertightness barrier.

Between the primary insulting barrier elements of the substructure 26 and of the adjacent panel 9 there therefore remains a depressed region, the depth of which is substantially the thickness of the primary insulating barrier and the bottom of which is formed by the flexible strip 55 and the peripheral rims 17 and 39. These depressed regions are filled by installing therein insulating tiles 56 each consisting of a layer of thermal insulation 57 of a thickness substantially equal to the thickness of the second layer of insulation 15 of the panel 9 and of a rigid sheet of plywood 58, substantially 12 mm thick. The insulating tiles 56, similar in design to the aforementioned tiles, allowing two juxtaposed panels 9 to be joined, have a size such that they completely fill the depressed region. The insulating tiles 56 are bonded to the strips 55 on the side of their insulating layer 57, so that once they have been installed, their plate 58 ensures continuity between the plates 16 and 32 of the substructure 26 and of the adjacent panel 9. The solid angles of intersection of the layer 57 facing toward the strip 55 are chamfered to allow any excess adhesive there might be when the tiles 56 are being fitted to seep out. These insulating tiles 56 may have any arbitrary longitudinal dimension, but are preferably quite short to make them easier to fit, even if there is a slight misalignment between the substructure 26 and the adjacent panel 9.

Thus, by fitting the corner structures 10 against the bearing structure 1, the secondary insulating barrier, the secondary watertightness barrier and the primary insulating barrier have been completed in one hit. It is clear that the amount of labor required is economical. Of course, the various wall elements, panels 9, corner structures 10 and insulating tiles 56 may be prefabricated on a mass-production scale at a factory, thus further improving the economical nature of this embodiment.

The primary watertightness barrier is placed on the substantially continuous surface formed by the rigid sheets 16 of the panels 9, the rigid plates 58 of the insulating tiles 56 and the rigid plates 32 of the corner structures 10 to be held thereon. Along the part of the bearing structure 1 covered with panels 9, except for the regions of the longitudinal solid angles of intersection A, the primary watertightness barrier is produced in the known way using the substantially flat running strakes 62, made of Invar sheet 0.7 mm thick.

In a known way, provision has been made, at the time of manufacture of the panels 9, for the inclusion in the plates 16 of longitudinal slots 59 having a cross section in the shape of an inverted T, the web of the T being perpendicular to the face of the plates 16, which faces the inside of the tank, and the two halves of the crossbar of the T being parallel to said face. A weld support 60 consisting of a profile in the shape of an L (or in the shape of an inverted T) having a cross section in the shape of a right-angle bracket is fitted in these slots 59, the long side of the L being welded to the turned-up edges 61 of two adjacent running strakes 62 of the primary watertightness barrier while the small side of the L is engaged in that part of the slot 59 which is parallel to the mean plane of the plates 16. The weld support 60 can slide inside the slot 59, which allows the running strakes 62 to move longitudinally with respect to the rigid plates 16 which support it. Each plate 16 of a panel 9 has two parallel slots 59 spaced apart by the width of a strake and arranged symmetrically with respect to the longitudinal axis of the panel 9. The dimensions of the panels 9 are contrived to be such that the distance between two adjacent welding flanges 60 fitted in two adjacent panels 9 is equal to the width of a running strake 62; a running strake 62 can thus be fitted in line with the central region of each plate 16, as partially visible in FIG. 2, and a running strake 62 (not depicted) can be fitted to straddle two adjacent panels 9.

According to the invention, a longitudinal slot 63 similar to the slots 59 in the panels 9 is also made in each rigid plate 58 of an insulating tile 56, substantially in the first third in the transverse direction of the tile 56 with respect to the adjacent panel 9, and a weld support 64 similar to the weld supports 60 carried by the panels 9 is inserted in it. A running strake 62 is welded via its turned-up longitudinal edges 61 to the weld support 64 and to a weld support 60 carried by the panel 9 on its half adjacent to the tile 56. As previously described, the primary watertightness barrier is produced, in the region of the solid angle of intersection of the dihedron 4, by the angle bracket 42 of the corner structure 10.

In order to achieve continuity of the primary watertightness barrier, a single longitudinal row of corner strakes 65, made of Invar sheet 1 mm thick, is arranged on each side of the angle bracket 42; each corner strake 65 having a first longitudinal edge 67 welded to the weld support 64 and its second longitudinal edge 68 welded to the angle bracket 42. In its transverse direction, each corner strake 65 has, in succession: its first longitudinal edge 67 turned up toward the inside of the tank and welded edge to edge with the running strake 62 on the support 64; a first flat part 69 covering, without being fixed thereto, part of the rigid plate 58 of the tile 56; a corrugated part 66 exhibiting three corrugations of substantially the same height and curvature, covering, without being fixed thereto, substantially the remainder of the rigid plate 58 of the tile 56, up to the boundary with the adjacent substructure 26; a second flat part 70 covering, without being fixed thereto, part of the third plate 32 of the said substructure 26 not covered by the angle bracket 42, then substantially the first half of the leg 43 which has the oblong hole 45; and finally the second longitudinal edge 68 of the corner strake 65 which is welded to the leg 43 between the solid angle of intersection of the angle bracket 42 and the oblong hole 45.

By way of a numerical example, the width of the running strakes 62 between two turned-up edges is about 500 mm and their length is about 40 m, that is to say the length of the tank. The width of the corner strakes is slightly greater than that of the running strakes. It is possible to take wall elements in which the thickness of the secondary insulating barrier is of the order of 180 mm and that of the primary insulating barrier of the order of 90 mm.

The way in which the tank behaves while it is being filled, particularly near the solid angles of intersection of the dihedra 4 of the bearing structure 1, will now be described with reference to FIG. 4. The various elements described hereinabove and forming the wall of the tank according to the invention are mounted on the bearing structure 1 empty at an ambient temperature generally of between 5 and 25° C. and at atmospheric pressure. When the tank is being filled with liquid methane at a temperature of about −160° C., two physical phenomena contribute to causing deformation of the wall elements of the tank: on the one hand, a pressure force F, proportional to the head of the liquid present above a given point on the wall, give or take the vapor pressure exerted at the surface of the liquid, is exerted at right angles on the interior face thereof; on the other hand, the wall placed in contact with the liquid methane thermally contracts over substantially its entire periphery.

The consequence of the first phenomenon is that of partially compressing the layers of insulation 13 and 15 of the panels 9, the layers of insulation 57 of the tiles 56 and the layers of insulation 28 and 31 of the corner structures 10, all made of a compressible material. The thinning of the primary and secondary insulating barriers of the tank as a result of such compression has the result of increasing the internal periphery of the tank, and therefore of stretching its primary watertightness barrier, this stretching being concentrated in the solid angle of intersection regions of said tank.

In order to withstand such stretching without tearing, the primary watertightness harrier is equipped, in the known way, with expansion gussets formed by the turned-up edges 61 of the running strakes 62, which can part elastically from the weld supports 60 to which their edges are welded, so as locally to increase the transverse dimension of the running strakes 62 by substantially 0.3 to 0.6 mm.

Figure 4:
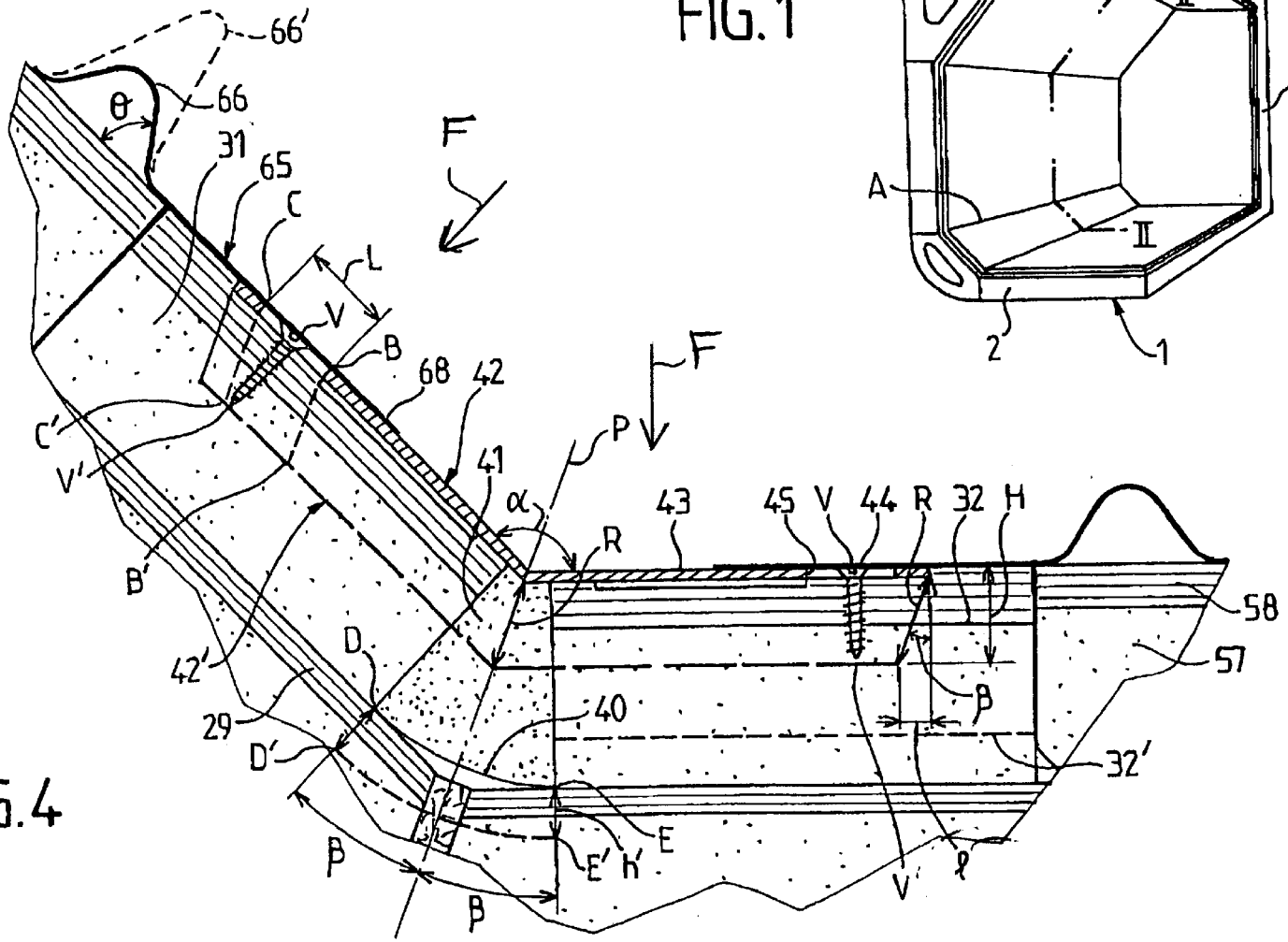
FIG. 4 is an enlarged partial view of a detail of FIG. 2 identified by the box IV, and showing the deformation of the wall.

As the static pressure exerted on the two faces forms a dihedron 4 which is substantially identical near its solid angle of intersection A, as represented by the arrows F in FIG. 4, the movement of the angle bracket 42 is overall in a retreating direction perpendicular to the solid angle of intersection A and substantially parallel to the bisecting plane P. The contraction H of the primary and secondary insulating barrier elements of each substructure 26 is substantially perpendicular to the longitudinal face 2 which carries it, between an empty position in which the rigid plate 32 is depicted in continuous line in FIG. 4 and a fully loaded position in which said plate is depicted in broken line in FIG. 4 and indicated by the FIG. 32' and may typically reach H=3 mm. The angle $\beta$ formed between the direction orthogonal to the longitudinal face 2 and the bisecting plane P is 22.5° for a dihedron angle $\alpha$ of 135°. The retreat $R=H/\cos\beta$ of the angle bracket 42 in said retreating direction therefore reaches a value as high as about 3.24 mm. The angle bracket is depicted in broken line and indicated by the reference numeral 42' in its retreated position. As a result of this retreat, it can be seen that the movement of the transverse ends of the angle bracket 42 relative to the bearing structure 1 causes a transverse elongation of the primary watertightness barrier of $1=R\sin\beta$ on each longitudinal face 2 forming the dihedron 4, which is substantially 1=1.24 mm.

Thus, the deformation of the turned-up edges 61 is not enough to cause the necessary transverse elongation. According to the invention, the corrugated part 66 of the corner strakes 65 provides an additional means of increasing the periphery of the primary watertightness barrier, it being possible for the corrugations to deform to increase the transverse dimension of the corner strake 65 within the required limits, namely at least the elongation l. The stiffness of the corrugated part 66 is preferably lower, and in no event higher, than that of the turned-up edges 61 of the corner strake 65, so as to lengthen first and predominantly.

As an alternative, just one corrugation 66', depicted in broken line in FIG. 4, of a greater height than the three aforementioned corrugations, could be formed in the corrugated part 66. However, such a choice would entail the angle θ formed between the plate 58 and the strake 65 at the base of the corrugation 66' being greater than it was in the case of the aforementioned three corrugations. Now, a large angle θ increases the risk that the pressure of the liquid contained in the tank will nip the corrugation 66' at its base, resulting in tension in the primary watertightness barrier, opposing the desired effect, and possibly in cracking of the Invar as a result of stress concentrations in excess of its plastic strength limit.

The retreat of the angle bracket 42 also has the result of causing transverse sliding of the plate 32 of each substructure 26 with respect to the leg 43 that it carries, over the distance l toward the outside of the solid angle of intersection A. This sliding is permitted by the oblong holes 45 in which the fixing screws 44 slide freely. As visible in FIG. 4, during this retreat, the head of the fixing screw 44 moves from a position V near the end B of the oblong hole 45, which is the interior end with respect to the solid angle of intersection A, to a position V' near to the outer end C. The length L of the holes 45 is at least equal to the sum of the elongation l and of the value of a movement of the plate 32 brought about by the thermal contraction of the triplex strip forming the secondary watertightness barrier. As this movement is toward the center of the face 2 which carries each substructure 26, it adds to the elongation l and measures, for example, about 1.7 mm. In total, the length L is preferably substantially equal to 3.1 mm.

During the aforementioned compression of the substructures 26, fixing points D and E of the flexible strip 40 to the parts of the rim 39 travel a distance h' substantially equal to a fraction of the contraction H perpendicularly toward the longitudinal faces 2 as indicated by the letters D' and E' in FIG. 4. This results in an increase substantially equal to the distance h' in the radius of curvature of the flexible strip 40.

The elongate orifices 47 form a clearance around the studs 6 engaged therein so as to allow the corner structure 10 to be mounted at the solid angle of intersection A of the tank.

Other deformations of the wall of the tank, other than those described hereinabove caused by the static pressure of the fluid contained in the tank may also be caused by the dynamic pressure due to the movement of said fluid in the tank, particularly in the upper part of the tank where a vapor phase of said fluid is in equilibrium with a liquid phase. In addition, the swell may generate waves at the surface of said liquid during transportation by sea. Thus, the contraction of the two substructures 26 of a corner structure 10 is not necessarily always equal.

The second phenomenon, that of thermal contraction, has a different influence on the primary watertightness barrier, the Invar strakes 62, 65 of which, although having a very low coefficient of contraction, contract by a tangible amount upon contact with the liquefied gas, and on the primary and secondary insulating barrier elements, the coefficient of contraction of which is far higher. This second phenomenon on the one hand has the tendency to cause the rigid plates 16, 58 and 32 to slide with respect to the strakes 62 and 65, something which is allowed through the fact that the strakes are placed without being fixed on the surface of said rigid plates and that the fixing screws 44 can slide in the oblong holes 45 of the angle bracket 42. On the other hand, the contraction of all of the primary and secondary insulating barrier elements carried by each longitudinal face 2 of a dihedron 4 may result in a transverse tensile force which contributes to the movement of the substructures 26 away from the solid angle of intersection A.

Although the invention has been described in conjunction with one particular embodiment, it is quite obvious that it is not in any way restricted thereto and that it comprises all technical equivalents of the means described and combinations thereof where these fall within the scope of the invention.

What is claimed is:

1. Watertight and thermally insulating tank built into a bearing structure (1), particularly of a ship, said bearing structure (1) having a number of substantially flat faces (2) adjacent via their longitudinal edges and having a polygonal cross section, each pair of longitudinally adjacent faces (2) forming a dihedron (4), said tank comprising two successive watertightness barriers, one of them a primary watertightness barrier (43, 65, 62) in contact with the product contained in the tank, and the other a secondary watertightness barrier (14, 55, 30, 40) arranged between said primary watertightness barrier and the bearing structure (1), a primary thermally insulating barrier (12,13,24,27,28,29,37,38, 51,54,71) being arranged between these two watertightness barriers and a secondary thermally insulating barrier (15,16, 57,58,31,32,41) being arranged between said secondary watertightness barrier and the bearing structure (1), the secondary insulating and watertightness barriers and the primary insulating barrier being essentially formed of a collection of wall elements (9,10,56) juxtaposed on the bearing structure (1) over substantially its entire interior surface (8), said wall elements (9,10,56) being partially deformable in the direction of their thickness, said wall elements (9,10,56) being capable of supporting and of retaining the primary watertightness barrier, said primary watertightness barrier having substantially flat running metal strakes (62) made of thin sheet metal with a low coefficient of expansion, the longitudinal edges (61) of which are turned up toward the inside of the tank, each running strake (62) being assembled watertightly with at least one longitudinally adjacent running strake (62), the adjacent turned-up edges (61) of said running strakes (62) being welded to the two faces of a weld support (60) which is mechanically held on said wall elements (9), characterized in that said primary watertightness barrier comprises, on each side of the longitudinal solid angle of intersection (A) of at least one of said dihedra (4), a longitudinal row of corrugated corner strakes (65), each corner strake (65) having a first longitudinal edge (67), opposite said solid angle of intersection (A) of the dihedron, which is turned up toward the inside of the tank and welded to one face of a weld support (64) held mechanically on said wall elements (56), the longitudinal edge of a running strake (62) longitudinally adjacent to said corner strake (65) being welded to the other face of said weld support (64), each corner strake (65) comprising at least one corrugation (66) between its two longitudinal edges (67,68) so as to be capable of deforming transversely to elastically follow any deformation there might be of said wall elements (9,10,56) supporting said primary watertightness barrier, it being possible for said deformation to be brought about by the static (F) or dynamic pressure of the product contained in said tank and/or the thermal contraction.

2. Tank according to claim 1, characterized in that each corner strake (65) has several, preferably three, corrugations (66) of substantially the same height or of the same height.

3. Tank according to claim 1, wherein the primary watertightness barrier comprises, at said solid angle of intersection (A) of the dihedron, a metal angle bracket, the angle of which is substantially equal to the angle ($\alpha$) of said dihedron, each corner strake having its second longitudinal edge welded to said metal angle bracket.

4. Tank according to claim 3, characterized in that said wall elements (9,10,56) comprise, on their opposite face to said bearing structure (1), support plates (16,32,58) forming a substantially continuous wall; each leg (43) of said angle bracket (42) being fixed to at least one of said support plates (32) by at least one fixing screw (44) engaged through an oblong hole (45) in said leg (43) and fixed into said support plate (32), said oblong hole (45) being substantially perpendicular to said solid angle of intersection (A) of the dihedron so as to offer said leg (43) limited freedom of movement (L) in this direction with respect to said support plate (32); each oblong hole (45) being covered by a corner strake (65), one longitudinal edge (68) of which is fixed to said leg (43) between the solid angle of intersection of said angle bracket (42) and said oblong hole (45).

5. Tank according to claim 1, wherein said wall elements comprise, along said solid angle of intersection (A) of the dihedron, prefabricated corner structures, each corner structure comprising two substructures designed and arranged substantially symmetrically with respect to the plane (P) that bisects said dihedron, each of said substructures having, in succession, through its thickness: a first rigid plate forming the bottom of the substructure, fixed mechanically and/or bonded to said bearing structure, a first layer of thermal insulation carried by said bottom plate, a second rigid plate covering substantially the entirety of said first layer to provide, with it and said bottom plate, a secondary insulating barrier element, a secondary watertightness barrier element bonded onto said second plate, a second layer of thermal insulation which partially covers said second plate, forming thereon a border not covered by said second layer, and a third rigid plate forming said support plate of the substructure and covering the second layer of thermal insulation to provide, with it, a primary insulating barrier element; the respective bottom plates of said substructures being respectively substantially parallel to the two faces of said dihedron.

6. Tank according to claim 4, wherein said wall elements comprise, along said solid angle of intersection (A) of the dihedron, prefabricated corner structures, each corner structure comprising two substructures designed and arranged substantially symmetrically with respect to the plane (P) that bisects said dihedron, each of said substructures having, in succession, through its thickness: a first rigid plate forming the bottom of the substructure, fixed mechanically and/or bonded to said bearing structure, a first layer of thermal insulation carried by said bottom plate, a second rigid plate covering substantially the entirety of said first layer to provide, with it and said bottom plate, a secondary insulating barrier element, a secondary watertightness barrier element bonded onto said second plate, a second layer of thermal insulation which partially covers said second plate, forming thereon a border not covered by said second layer, and a third rigid plate forming said support plate of the substructure and covering the second layer of thermal insulation to provide, with it, a primary insulating barrier element; the respective bottom plates of said substructures being respectively substantially parallel to the two faces of said dihedron, and wherein the two legs of said angle bracket are fixed respectively to the support plates of said two substructures.

7. Tank according to one of claim 5, wherein a rigid thrust plate is inserted between the secondary insulating barrier elements of said two substructures substantially in said plane (P) that bisects the dihedron, said secondary insulating barrier hi elements of the two substructures each having a longitudinal face substantially parallel to said bisecting plane (P) and bearing against said thrust plate.

8. Tank according to claim 5, wherein the secondary insulating end barrier elements of the two substructures of each corner structure have a facet cut substantially at right angles to said bisecting plane (P) so as to define an empty space between said corner structure and the solid angle of intersection of the dihedron of the to bearing structure, a sheet of tension-resistant insulating material covering said cut facet in order to hold said two substructures together.

9. Tank according to claim 5, wherein each corner structure comprises a continuous, gas tight and liquid tight flexible web, preferably comprising a continuous deformable thin sheet of aluminum interposed between two sheets of glass fabric, two border parts of which are respectively fixed watertightly to the secondary watertightness barrier elements of the two substructures, a central part of said web, which passes through said bisecting plane (P) not being fixed to said substructures, so as to allow it to adopt a variable curvature as the corner structures deform in said way.

10. Tank according to claim 5, wherein a corner gasket made of flexible insulating material is inserted between the primary insulating barrier elements of said two substructures and on said web, said corner gasket not being fixed to said web.

11. Tank according to claim 5, wherein the bearing structure comprises metal flats welded to its internal surface parallel to said solid angle of intersection (A) of the dihedron and on each side thereof, the bottom plate of each substructure of a corner structure being positioned between said solid angle of intersection (A) of the dihedron and one of said flats; a corner structure being fixed to the bearing structure using studs welded substantially perpendicularly to the internal surface of the bearing structure, said studs each having their free end threaded, the studs being arranged in such a way that the studs lie between said solid angle of intersection (A) of the dihedron and said flats, in line with said border not covered with the secondary insulating barrier elements of each substructure, a well being formed in line with each stud through the second plate and the first layer of thermal insulation of a substructure, the bottom of the well being formed by the bottom plate of said substructure and having an elongate orifice to allow a stud to pass, a washer being placed over the stud to rest against the bottom plate, held on by a nut screwed onto said stud, said elongate orifice being oriented substantially at right angles to said solid angle of intersection (A) of the dihedron, said stud being engaged near the end of said elongate orifice away from said solid angle of intersection of the dihedron so as to allow said bottom plate a limited movement with respect to said bearing structure toward said flat, a deformable wad, preferably of curable resin, being inserted between said flat and said bottom plate.

12. Tank according to claim 5, wherein said wall elements comprise prefabricated panels, each panel comprising, in succession, through its thickness: a first rigid sheet forming the bottom of the panel, fixed mechanically and/or bonded to said bearing structure, a first layer of thermal insulation carried by said bottom plate to provide, with it, a secondary insulating barrier element, a second layer of thermal insulation which partially covers said first layer, forming thereon a border not covered by said second layer, and a second rigid sheet forming said support plate of the panel and covering the secondary layer of thermal insulation to provide, with it, a primary insulating barrier element.

13. Tank according to claim 12, characterize in that said wall elements also comprise insulating tiles (56), each comprising a layer of thermal insulation (57) covered by a rigid plate (58) forming said support plate for the insulating tile (56), at least one of said insulating tiles (56) being bonded in each region where the primary insulating barrier element (31,32) of a substructure (26) of the corner structure (10) meets the primary insulating barrier element (15,16) of a panel (9) adjacent to said corner structure (10), so as to fill the region of this joint.

14. Tank according to claim 1, wherein the angle ($\alpha$) of said dihedron is greater than 90°, and preferably substantially equal to 135°.

15. Tank according to claim 1, wherein the primary watertightness barrier comprises, at said solid angle of intersection (A) of the dihedron, a metal angle bracket, the angle of which is substantially equal to the angle ($\alpha$) of said dihedron, each corner strake having its second longitudinal edge welded to said metal angle bracket.

16. Tank according to claim 2, wherein said wall elements comprise, along said solid angle of intersection (A) of the dihedron, prefabricated corner structures, each corner structure comprising two substructures designed and arranged substantially symmetrically with respect to the plane (P) that bisects said dihedron, each of said substructures having, in succession, through its thickness: a first rigid plate forming the bottom of the substructure, fixed mechanically and/or bonded to said bearing structure, a first layer of thermal insulation carried by said bottom plate, a second rigid plate covering substantially the entirety of said first layer to provide, with it and said bottom plate, a secondary insulating barrier element, a secondary watertightness barrier element bonded onto said second plate, a second layer of thermal insulation which partially covers said second plate, forming thereon a border not covered by said second layer, and a third rigid plate forming said support plate of the substructure and covering the second layer of thermal insulation to provide, with it, a primary insulating barrier element; the respective bottom plates of said substructures being respectively substantially parallel to the two faces of said dihedron.

17. Tank according to claim 3, wherein said wall elements comprise, along said solid angle of intersection (A) of the dihedron, prefabricated corner structures, each corner structure comprising two substructures designed and arranged substantially symmetrically with respect to the plane (P) that bisects said dihedron, each of said substructures having, in succession, through its thickness: a first rigid plate forming the bottom of the substructure, fixed mechanically and/or bonded to said bearing structure, a first layer of thermal insulation carried by said bottom plate, a second rigid plate covering substantially the entirety of said first layer to provide, with it and said bottom plate, a secondary insulating barrier element, a secondary watertightness barrier element bonded onto said second plate, a second layer of thermal insulation which partially covers said second plate, forming thereon a border not covered by said second layer, and a third rigid plate forming said support plate of the substructure and covering the second layer of thermal insulation to provide, with it, a primary insulating barrier element; the respective bottom plates of said substructures being respectively substantially parallel to the two faces of said dihedron.

18. Tank according to claim 4, wherein said wall elements comprise, along said solid angle of intersection (A) of the dihedron, prefabricated corner structures, each corner structure comprising two substructures designed and arranged substantially symmetrically with respect to the plane (P) that bisects said dihedron, each of said substructures having, in succession, through its thickness: a first rigid plate forming the bottom of the substructure, fixed mechanically and/or bonded to said bearing structure, a first layer of thermal insulation carried by said bottom plate, a second rigid plate covering substantially the entirety of said first layer to provide, with it and said bottom plate, a secondary insulating barrier element, a secondary watertightness barrier element bonded onto said second plate, a second layer of thermal insulation which partially covers said second plate, forming thereon a border not covered by said second layer, and a third rigid plate forming said support plate of the substructure and covering the second layer of thermal insulation to provide, with it, a primary insulating barrier element; the respective bottom plates of said substructures being respectively substantially parallel to the two faces of said dihedron.

19. Tank according to claim 5, wherein the two legs of said angle bracket are fixed respectively to the support plates of said two substructures.

20. Tank according to one of claim 6, wherein a rigid thrust plate is inserted between the secondary insulating barrier elements of said two substructures substantially in said plane (P) that bisects the dihedron, said secondary insulating barrier elements of the two substructures each having a longitudinal face substantially parallel to said bisecting plane (P) and bearing against said thrust plate.

* * * * *